US005080070A

United States Patent [19]

Hafner

[11] Patent Number: 5,080,070

[45] Date of Patent: Jan. 14, 1992

[54] HYDRAULIC CIRCUIT OF A FUEL INJECTION SYSTEM

[75] Inventor: Udo Hafner, Lorch, Fed. Rep. of Germany

[73] Assignee: Roberts Bosch GmbH, Stuttgart, Fed. Rep. of Germany

[21] Appl. No.: 134,718

[22] Filed: Dec. 18, 1987

[30] Foreign Application Priority Data

Feb. 24, 1987 [DE] Fed. Rep. of Germany ..... 3705848

[51] Int. Cl.[5] ..... F02M 55/02

[52] U.S. Cl. ..... 123/470; 123/472; 123/468; 123/456

[58] Field of Search ..... 123/472, 468, 469, 470, 123/471, 456, 514

[56] References Cited

U.S. PATENT DOCUMENTS

| | | | |
|---|---|---|---|
| 3,924,583 | 12/1975 | Jardin | 123/469 |
| 4,186,708 | 2/1980 | Bowler | 123/472 |
| 4,334,512 | 6/1982 | Biernath | 123/469 |
| 4,347,823 | 9/1982 | Kessler | 123/472 |
| 4,436,071 | 2/1984 | Hafner | 123/472 |
| 4,485,790 | 12/1984 | Nishimura | 123/468 |
| 4,601,275 | 7/1986 | Weinan | 123/468 |
| 4,831,943 | 7/1974 | Unnalewski | 123/472 |

*Primary Examiner*—Carl Stuart Miller

*Attorney, Agent, or Firm*—Edwin E. Greigg; Ronald E. Greigg

[57] ABSTRACT

A hydraulic circuit for a fuel injection system having fuel injection valves, in which even under hot start conditions in an internal combustion engine, it is assured that the engine will start and continue to operate reliably. The hydraulic circuit is embodied such that the fuel pumped by a fuel feed pump into a fuel supply line reaches an annular fuel inflow chamber of a valve socket of a first fuel injection valve, and from there can flow through the fuel injection valve and emerges into an annular fuel return groove in the valve socket, from which it can flow via a connection to the annular fuel inflow chamber of the next fuel injection valve in succession. The fuel returns upwardly so that any air in the fuel will go upwardly with the fuel.

3 Claims, 2 Drawing Sheets

HYDRAULIC CIRCUIT OF A FUEL INJECTION SYSTEM

BACKGROUND OF THE INVENTION

The invention is based on a hydraulic circuit of a fuel injection system. A hydraulic circuit is already known in which a separate tie line branches off from the fuel supply line to each of the injection valves, and the fuel not injected is carried from each of the fuel injection valves to a fuel return line. There is no assurance that each fuel injection valve will be supplied well enough with fuel that reliable engine starting is attained by means of rapid flushing out of the vapor bubbles from the injection valves and cooling down of the heated fuel injection valves, especially in a so-called hot start, in which fuel is present in vapor form in the fuel lines and in the individual fuel injection valves.

OBJECT AND SUMMARY OF THE INVENTION

The hydraulic circulatory system according to the invention has the advantage over the prior art that rapid, indeed compulsory, thorough flushing of the fuel injection valves is assured, so that under hot start conditions, and rapid cooling down of the fuel injection valves, the necessary supply of fuel to the engine is assured and the engine starts and keeps running without interruptions, by means of rapid flushing of any fuel vapor that may be present out of the fuel injection valves and away from the valve seat Particularly advantageous developments and improvements of the hydraulic circuit defined herein are attained with the provisions set forth. A particularly advantageous feature is to dispose the annular fuel return groove higher than the annular fuel inflow groove in the installed position of the fuel injection valve, in the direction of the flow of the fuel to the annular fuel return groove, so that any fuel vapor that may have formed rises on its own away from the valve seat. Another advantage is to connect the annular fuel return groove and the annular inflow groove to one another outside the fuel injection valve by means of a throttle restriction, so as to vary the flow of fuel through the fuel injection valve as a function of the cross section of the throttle restriction.

The invention will be better understood and further objects and advantages thereof will become more apparent from the ensuing detailed description of a preferred embodiment taken in co junction with the drawings.

DESCRIPTION OF THE PREFERRED EMBODIMENT

Figure 1:
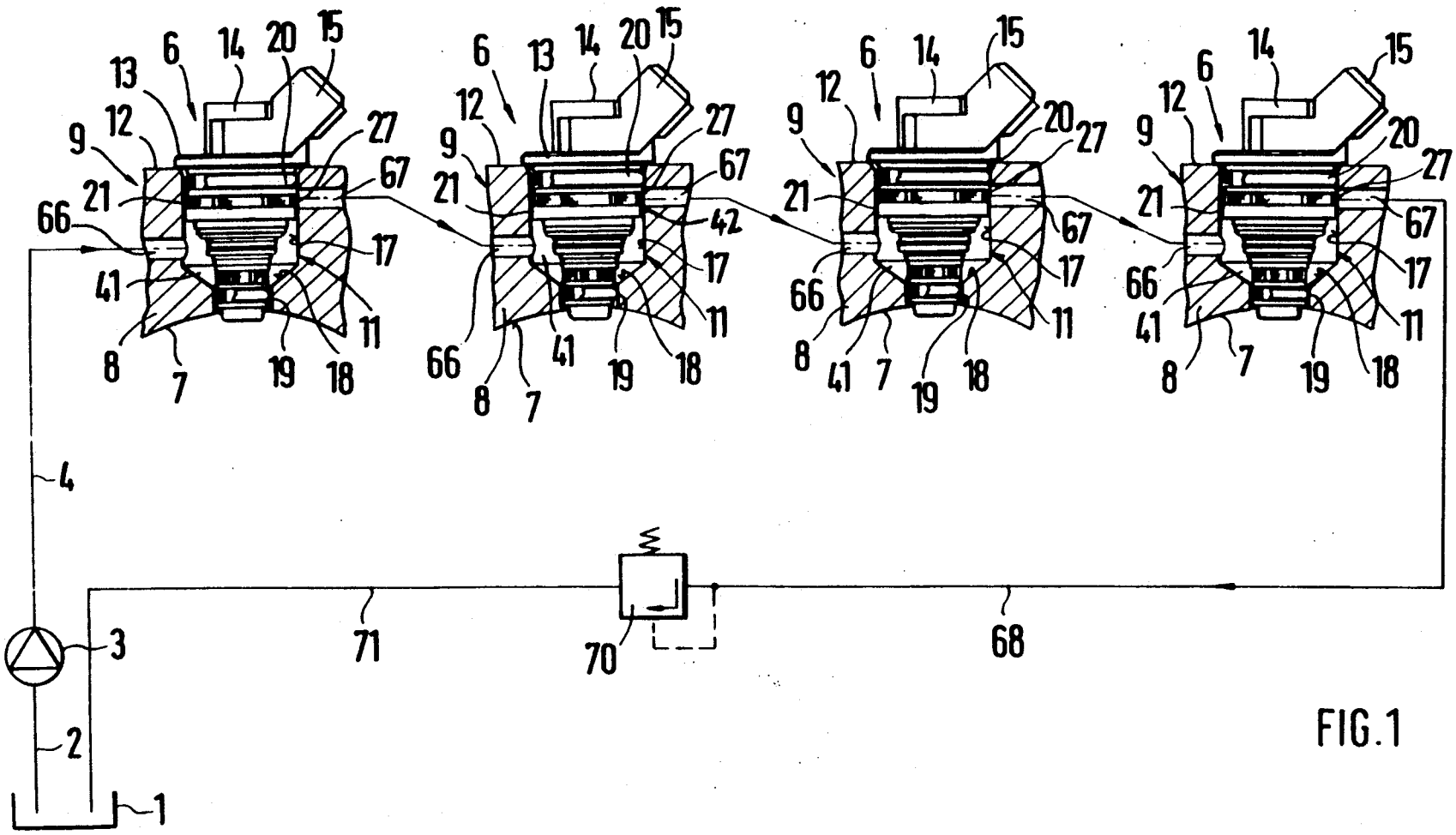
FIG. 1 shows a hydraulic circuit of a fuel injection system, embodied in accordance with the invention.
Figure 2:
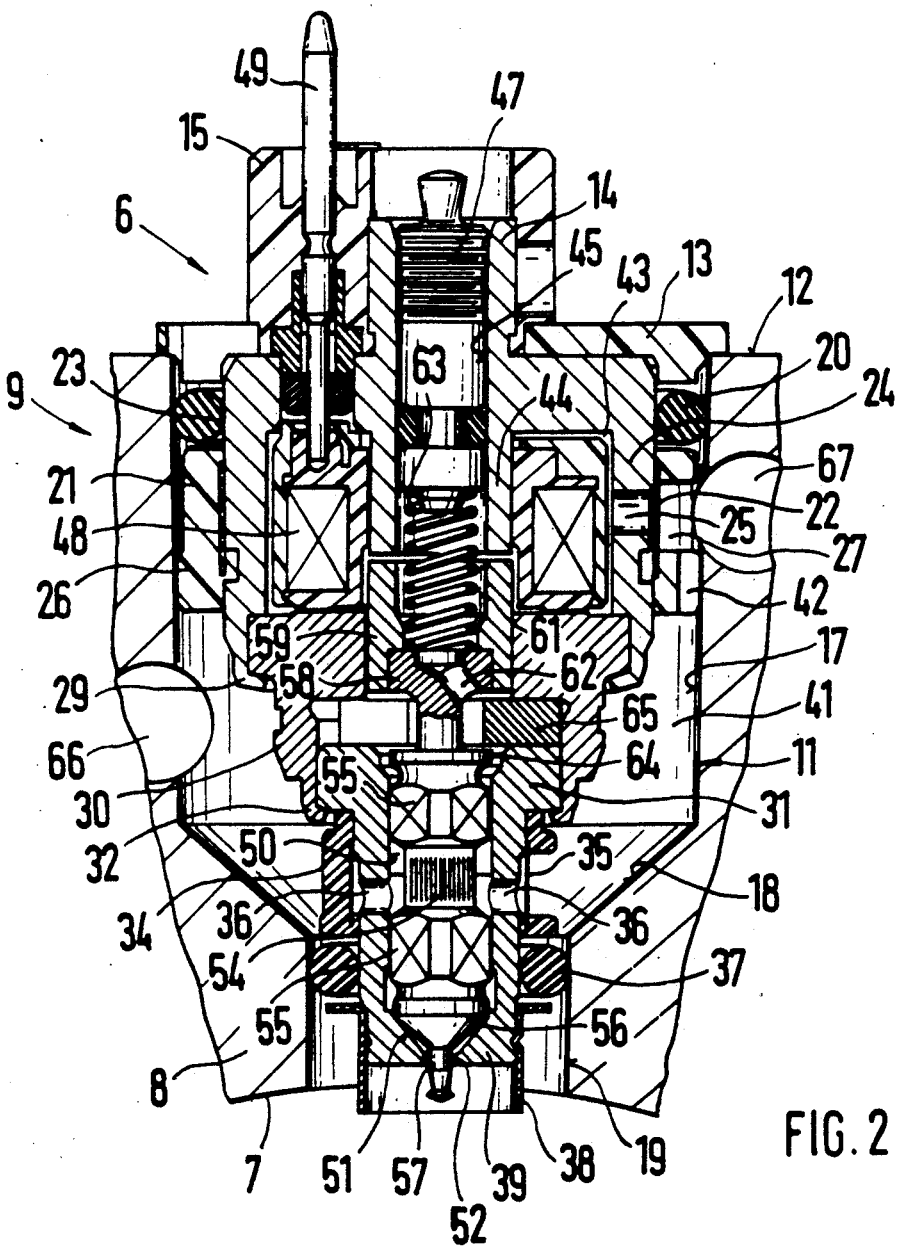
FIG. 2 is a section taken through a single fuel injection valve.

In FIG. 1, a hydraulic circulatory system of a fuel injection system for mixture-compressing internal combustion engines having externally supplied ignition is shown. It includes a fuel tank 1, from which a fuel pump 3, pumps fuel via a feed line 2 to a fuel supply line 4. The hydraulic circulatory system serves to supply fuel to electromagnetically actuatable fuel injection valves 6, which are disposed on individual intake tubes leading from a manifold to each cylinder, or on each cylinder 7, directly upstream from the inlet valves, not shown, of the engine. Each of the fuel injection valves 6 is inserted into a separate valve socket 9, which is part of the associated individual intake tube 7 or cylinder 8 as the case may be. Each valve socket 9 has a socket opening 11, which extends with a varying diameter from a bearing end face 12 of each valve socket 9 as far as the individual intake tube 7. As shown in FIG. 2, the fuel injection valve 6 rests on the bearing face 12 with a collar 13 protruding beyond the bearing face 12 into the valve socket. A threaded pipe connector 14 and an electric plug 15 protrudes outward from the socket opening 11, beginning at the collar 13. Beginning at the bearing face 12, the socket opening 11 has a first guide section 17, a tapering conical section 18 adjoining it, the first guide section and a cylindrical second guide section 19, which discharges into the individual intake tube. A first sealing ring surrounds the pipe connector 14 inwardly of the collar 13 and an axially aligned first annular filter body 21 surrounds the pipe connector inwardly of the first sealing ring. The first filter body 21 includes a first filter 22 which surrounds a portion of the cylindrical jacket 23 of a cup-shaped valve housing 24 in the vicinity of outflow openings 25 that penetrate the valve housing. Remote from the collar 13, the first filter body has an annular rim 26 which is radially sealed off from the wall of the first guide section 17 and thus defines an annular fuel return groove 27, which is further defined by the first sealing ring 20, the jacket 23 of the valve housing 24 and the wall of the first guide section 17. Inserted partway into the valve housing 24 and crimped to it at one end 29 is a nozzle holder 30, into which a nozzle body 31 is inserted partway and crimped with it at at end 32. Like the valve housing 24, the nozzle holder 30 and the nozzle body 31 also extends through the first guide section 17, the conical section 18 and the second guide section 19 with radial play. A second annular filter body 34 having a second filter 35 is mounted on the nozzle holder 31, surrounding the nozzle holder in the vicinity of inflow openings 36 that radially penetrate the nozzle holder 31. Adjoining the second filter body 34 in the direction toward the second guide section 19, a second sealing ring 37 and a protective sheath 38 are disposed on the nozzle holder 31, surrounding the end 39 of the mouth of the nozzle holder 31 and protruding partway into the individual intake tube 7. The second sealing ring 37 is in radially sealing contact with the outer circumference of the nozzle body 31 and with the inner face of the wall of the second guide section 19. Enclosed between the second sealing ring 37 and the annular rim 26 of the first filter body 21 is an annular fuel inflow chamber 41, which is defined in the radial direction by the wall of the fuel injection valve and of the socket opening 11. Thus in the installed state of the fuel injection valve 6, the annular fuel return groove 27 is at a higher level in the valve socket 9 than the annular fuel inflow chamber 41, from which it is separated by the annular rim 26 of the first filter body 21. An axial groove 42 on the circumference of the annular rim 21 of the first filter body 26 acts as a throttle restriction and connects the annular fuel inflow chamber directly with the annular fuel return groove. A core 44 aligned with the pipe connector 14 protrudes into an interior chamber 43 of the valve housing 24. An insert opening 45 that serves as an extension of the pipe connector 14 is formed in this core 44 and in a press fit receives an actuating tappet 47 in this core 44. Mounted on the core 44 is a magnet coil 48, which does not completely fill the interior chamber 43, and which can be electrically conductively connected via contact pins 49 in the plug 15 to an electronic control unit, not shown. A guide bore 59 is embodied in the nozzle body 31, merging at the mouth end 39 with a conical valve seat 51, which is adjoined by a cylindrical nozzle body 52, by way of which the injection of fuel into the individual intake tube 7 is effected. A valve needle 54, which is guided in the guide bore 51 by two slide sections 55 spaced axially apart from one another, protrudes into the guide bore 50 and has a conical sealing section 56, adjacent the valve seat 51 and cooperating with it, which sealing section 56 terminates in the form of a tang 57 that protrudes through the nozzle bore 52. An annular gap that meters the fuel is formed between the jacket of the tang 57 and the wall of the nozzle bore. Secured to a head 58 of the valve needle 54 remote from the tang 57 is a cylindrical armature 59, which is oriented toward the core 44 and has an air gap with respect to the core. The slide sections 55 of the valve needle are provided with axially extending faces, embodied for example as squares or rectangles, in cross section, as a result of which a flow of fuel via the slide sections in the axial direction is possible. The armature 50 has a central bore 61, which merges in hydraulic communication with an oblique bore 62 leading from the center of the head 58 to the needle jacket, so that fuel flowing via the slide sections 55 can flow into the oblique bore and from there into the central bore 61 and around the end of the armature, so that it can reach the interior chamber 43, which in turn communicates with the outflow opening 25. On the other end, the guide bore 50 communicates with the inflow opening 36, so that as a result of the abovedescribed flow routes, a flow through the fuel injection valve is dictated, beginning at the inflow opening 36 and extending away from the valve seat 51 toward the outflow opening 25 The quantity of fuel that flows along this route from the inflow opening or openings 36 to the outflow opening or openings 25 can be varied by the selection of the cross section of the axial groove 42 in the annular rim 26.

A compression spring 63 which is supported on the head 58 protrudes into the central bore 61 of the armature 59 and is supported on its other end on the actuating tappet 47 which for adjustment of the effective spring force can be inserted to a variable extent into the insert opening 45 and secured therein. In a known manner, the reciprocating movement of the valve needle can be limited by means of a stop collar 64 on the valve needle, which collar comes to rest, in the excited state of the magnet coil, on a stop ring 65 that protrudes through the valve needle.

An inflow conduit 66 formed in each valve socket 9 discharges into each annular fuel inflow chamber 41, with which the inflow openings 36 to the valve nozzle in turn communicate. An outflow conduit 67 formed in each valve socket 9 leads away from the annular fuel return groove 27. Any fuel vapor bubbles that get into or form in the fuel injection valve are immediately flushed upward with the fuel and returned t the annular fuel return groove 27.

According to the invention, the fuel supply line 4 communicates with the inflow conduit 66 in the valve socket 9 of the first fuel injection valve disposed in the hydraulic circuit, while the fuel carried away from the first fuel injection valve by the outflow conduit 67 is carried into the inflow conduit to the second fuel injection valve in succession, so that in each of the ensuing valves, there is hydraulic communication for the fuel from the outflow conduit 67 of the previous fuel injection valve to the inflow conduit 66 of the next fuel injection valve. The outflow conduit 67 of the last fuel injection valve, that is, in the exemplary embodiment shown, the fourth of the fuel injection valves arranged in a row, communicates with a fuel return line 68, which via a pressure regulating valve 70 discharges into a return line 71 that leads back to the fuel tank 1.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A hydraulic circuit of a fuel injection system for internal combustion engines, having a fuel supply pump (3) that pumps fuel into a supply line (4), a first and at least one additional fuel injection valve disposed in separate individual valve sockets (9), each said injection valve having an annular fuel supply inflow chamber (41) formed between said injection valve and said valve socket, a separate annular fuel return groove (27) formed between the fuel injection valve and the valve socket and axially spaced apart from said annular fuel supply inflow chamber, at least one inflow opening (36) from said annular fuel supply inflow chamber (41) into each separate fuel injection valve and a fuel flow path from each inflow opening (36) to at least one outflow opening (25) in each said fuel injection valve, each said outflow opening (25) leads to said annular fuel return groove (27), wherein said fuel supply line discharges into said annular fuel supply inflow chamber of said first fuel injection valve, and an annular fuel inflow chamber (41) of each subsequent fuel injection valve (6) communicates with said annular fuel return groove (27) of the previous fuel injection valve (6) via a separate fuel flow line.

2. A hydraulic circuit as defined by claim 1, in which said annular fuel return groove (27), in an installed state of said fuel injection valve (6), is at a higher level than said annular fuel inflow chamber (41) of said injection valve.

3. A hydraulic circuit as defined by claim 2, in which said annular fuel inflow chamber (41) and the annular fuel return groove (27) communicate with one another by means of a throttle restriction (42) in an outer wall of said fuel injection valve (6).

* * * * *